US012042105B2

(12) United States Patent
Struthers

(10) Patent No.: US 12,042,105 B2
(45) Date of Patent: Jul. 23, 2024

(54) SOAP DISPENSING APPARATUS AND METHOD OF USE THEREOF

(71) Applicant: Robert Struthers, Apple Valley, CA (US)

(72) Inventor: Robert Struthers, Apple Valley, CA (US)

( * ) Notice: Subject to any disclaimer, the term of this patent is extended or adjusted under 35 U.S.C. 154(b) by 137 days.

(21) Appl. No.: 17/359,265

(22) Filed: Jun. 25, 2021

(65) Prior Publication Data

US 2021/0401241 A1 Dec. 30, 2021

Related U.S. Application Data

(60) Provisional application No. 63/044,329, filed on Jun. 25, 2020.

(51) Int. Cl.
*A47K 5/12* (2006.01)
*A47K 7/02* (2006.01)
*A47K 7/03* (2006.01)

(52) U.S. Cl.
CPC ..... *A47K 7/03* (2013.01); *A47K 5/1201* (2013.01); *A47K 7/028* (2013.01)

(58) Field of Classification Search
CPC ..... A46B 11/0027; A45D 40/04; A45D 2200/055; B65D 83/0011; B65D 83/0005; A47K 5/1201; A47K 7/03; A47K 7/028
See application file for complete search history.

(56) References Cited

U.S. PATENT DOCUMENTS 576,898 A * 2/1897 Santee ..... A46B 11/0027 401/175
1,190,228 A * 7/1916 Fesler ..... A46B 11/0027 401/175
1,382,161 A * 6/1921 Bates ..... A46B 11/0027 401/172
1,403,426 A * 1/1922 Loeben ..... A46B 11/0027 401/175
1,465,220 A * 8/1923 Huether ..... A46B 11/0027 401/172
1,909,146 A * 5/1933 Bohanan ..... A46B 11/0031 401/174
1,932,686 A * 10/1933 Boulds ..... A46B 11/0027 401/175
2,162,907 A * 6/1939 Bambach ..... A46B 11/0027 401/172
2,728,097 A * 12/1955 Seifert ..... A46B 11/0027 401/175
3,130,442 A * 4/1964 Kellis ..... A47K 5/1201 401/278
8,002,486 B1 8/2011 Tran
(Continued)

*Primary Examiner* — Frederick C Nicolas
(74) *Attorney, Agent, or Firm* — Innovent Law, P.C; Karima Gulick

(57) ABSTRACT

A soap dispensing apparatus includes a scrubber element, a housing, and a soap cartridge adapted to be received by the housing. The housing has a top face and a base that are removably couplable, wherein the scrubber element is removably couplable to the top face, the top face includes a plurality of soap dispensing channels. The housing and the soap cartridge form a reservoir adapted to receive a liquid soap and fluidly coupled to the soap dispensing channels. Further, the base is decoupled from the top face in order to fill the liquid soap in the reservoir.

10 Claims, 9 Drawing Sheets

(56) References Cited

U.S. PATENT DOCUMENTS

| | | | | |
|---|---|---|---|---|
| 9,877,619 | B1 | 1/2018 | Diaz | |
| 9,918,593 | B2 | 3/2018 | LeBlanc et al. | |
| 2016/0287033 | A1 | 10/2016 | LeBlanc et al. | |
| 2020/0305654 | A1* | 10/2020 | Eivaz ..... | A46B 11/0062 |

* cited by examiner

SOAP DISPENSING APPARATUS AND METHOD OF USE THEREOF

CROSS REFERENCE TO RELATED APPLICATIONS

This application claims the benefit of U.S. Provisional Application. No. 63/044,329, filed Jun. 25, 2020, entitled SOAP DISPENSING APPARATUS AND METHOD OF USE THEREOF which is hereby incorporated by reference in its entirety.

BACKGROUND OF THE INVENTION

1. Field of the Disclosure

This invention relates to a soap dispensing apparatus generally and a soap dispensing apparatus with a scrubber element in particular.

2. Description of the Related Art

While there are many personal cleaning devices in the marketplace, few cleaning devices include a cleansing portion and a soap delivery system in one apparatus. In fact, one of the most popular cleaning devices are wash cloths used in conjunction with bar soaps or liquid soap, loofahs and/or brushes used in conjunction with soap. However, holding a bath sponge in one hand while holding a bottle of liquid soap in the other is not a very convenient way of taking a bath or shower. In addition, having multiple devices for such a purpose is cumbersome and creates clutter in the bathroom often leading to having many objects falling in the shower. It would be desirable to have a soap dispensing cleaning apparatus that can automatically dispense an adequate amount of liquid soap while being used such that the necessity of using a separate bottle of soap is eliminated.

U.S. Pat. No. 6,656,565 to Harrison (2001) demonstrates the design for a loofah washcloth with linear openings for inserting four fingers to better grasp the cloth. However, this design requires the user to insert their fingers into the cloth, similar to a glove, which is not only impractical and time consuming, but difficult for people with arthritic hands and joints.

The use of liquid soaps or shower gels, as opposed to bar soaps that have been used for years, has become a household staple as it does not leave a hard to remove layer of soap scum in the shower or bath. The first patent for liquid soap, U.S. Pat. No. 49,561, was granted in 1865 to inventor William Sheppard for his "Improved Liquid Soap." Since then, the market for liquid soap and shower gels has exploded with a variety of formulations, scents, and consistencies.

In combining the two, liquid soap with a loofah or other body scrubbing apparatuses, U.S. Pat. No. 6,983,866 to Smart and Sticht (2006) discloses a soap dispensing bath brush which requires users to wrap their fingers around a brush handle to scrub and apply soap to their body. This design poses a problem with individuals with arthritic fingers, or those recovering from surgery or breaks, as they are unable to grasp the brush handle in a meaningful fashion.

U.S. Pat. No. 8,002,486 to Tran (2011) demonstrates a bath sponge with a built-in dispenser in which a gate partitioning the soap dispenser cavity opens at the push of a button to release liquid soap onto the sponge. However, grasping of the device, and the need to push the spring-loaded gate release button, can prove to be too cumbersome for the estimated 54.4 million U.S. adults suffering from arthritis as of 2015, according to the Centers for Disease Control and Prevention.

The present disclosure aims to solve that issue and aims to solve plastic waste by obviating the need for separate soap bottles.

SUMMARY OF THE DISCLOSURE

In one aspect, the present disclosure embodies a soap dispensing apparatus comprising a housing which includes a top face and a base directly opposite the top face, a scrubber element which can be removably coupled to the top face, a plurality of soap dispensing channels disposed on the top face. The dispensing channels are fluidly coupled to a soap platform where the soap platform is adapted to sit in the housing. The soap dispensing apparatus includes a reservoir adapted to receive a liquid soap, a spindle, a platform adapted to move along a length of the spindle, and a handle adapted to rotate about an axis defined by the length of the spindle. Here, the spinning and rotation of the handle pushes the platform up the length of the spindle and moves the liquid soap to the top face and out the dispensing channels. The soap dispensing apparatus is leak resistant.

In one embodiment, the reservoir also includes an inner wall such that the connection between the inner wall, the platform and the spindle form a tight seal and render the soap dispensing apparatus leak resistant. In other embodiments, the reservoir also includes a seal coupled to the platform rendering the soap dispensing apparatus leak resistant.

In one particular embodiment, the soap dispensing channels vary in size and opening diameter to match a viscosity of the liquid soap and optimize the flow of the liquid soap dispensing.

In another embodiment, the scrubber element surrounds an outer perimeter of the top face. The soap dispensing apparatus can include a ridge adjacent to the top face of the housing adapted to receive a removably couplable scrubber element and wherein said scrubber element is elastically couplable to the soap dispensing apparatus. The soap platform can be refillable and refilled by a user, and in some embodiments, the soap platform is removably couplable to the housing such that a user can remove and replace the soap platform.

In an alternative embodiment, the soap platform comprises a regulating means structurally engageable with the top face such that a user can rotate the handle and knob and engage the regulating means to adjust a flow of the liquid soap to be dispensed. The handle can be a knob, a protrusion, an elongated arm, and/or a grip, and the scrubbing element can be a loofah, a sponge, a washcloth, a plurality of bristles, a plurality of filaments, and/or a plurality of protruding elements.

In an another embodiment, the soap dispensing apparatus includes a housing with a top face and a base directly opposite the top face and a groove along a perimeter of the top face, a scrubber element removably couplable to the top face and adapted to be positioned on the groove of the housing. The soap dispensing apparatus also includes a plurality of soap dispensing channels disposed on the top face fluidly coupled to a soap platform. The soap platform is adapted to be housed by the housing, and the soap dispensing apparatus comprises a reservoir adapted to receive a liquid soap; a spindle; a platform parallel said based adapted to move perpendicularly along a length of the spindle; a handle adapted to rotate about an axis defined by the length of the spindle thereby pushing the platform up the length of the spindle and moving the liquid soap to the top face and wherein the soap dispensing apparatus is leak resistant.

In some embodiments, the reservoir also includes a seal coupled to the platform thereby rendering the soap dispensing apparatus leak resistant. In one particular embodiment, the apparatus also includes a rotating lid including a plurality of openings such that when the lid is rotated, it adjusts a diameter of the soap dispensing channels adapted to match a viscosity of the liquid soap, and when the liquid soap has low viscosity, it utilizes a smaller diameter of the dispensing channels, and a high viscosity liquid soap utilizes a larger diameter of the dispensing channels.

The scrubber element surrounds an outer perimeter of the top face in one embodiment, such that a portion of the dispensing channels is visible. The soap platform can be removably couplable to the housing such that a user can remove and replace the soap platform, and can be refilled and refillable such that a user can add the liquid soap to the reservoir.

The present disclosure can also be embodied in a method of using a soap dispensing apparatus, including the steps of: a) inserting a platform carrying a soap into the apparatus; b) twisting a handle on the soap dispensing apparatus to dispense a liquid soap; and c) gripping the apparatus by a handle and using it to scrub a body of a person. Other embodiments and methods include the steps of removing the platform from said apparatus and replacing the platform once a soap is depleted, while others include the steps of refilling the soap dispensing apparatus with a liquid soap.

Before explaining the various embodiments of the invention in detail, it is to be understood that the invention is not limited in its application to the details of construction and to the arrangements of the components set forth in the following description or illustrated in the drawings. Rather, the invention is capable of other embodiments and of being practiced and carried out in various ways. Also, it is to be understood that the terminology employed herein is for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

For a better understanding of the invention, its operating advantages and the specific objects attained by its uses, reference should be made to the accompanying drawings and descriptive matter in which there are illustrated preferred embodiments of the invention.

Various objects, features, aspects and advantages of the present embodiment will become more apparent from the following detailed description of embodiments of the embodiment, along with the accompanying drawings in which like numerals represent like components.

BRIEF DESCRIPTION OF THE DRAWINGS

The same elements or parts throughout the figures of the drawings are designated by the same reference characters, while equivalent elements bear a prime designation.

DETAILED DESCRIPTION OF THE INVENTION

Figure 1:
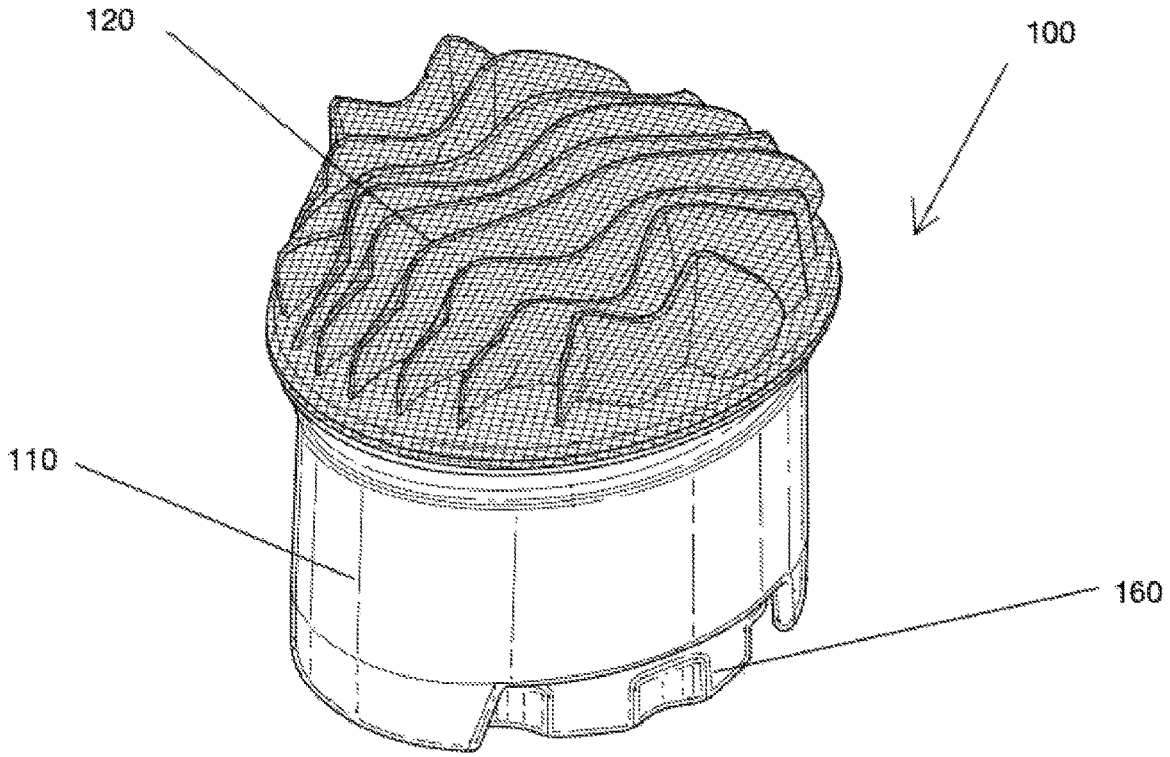
FIG. 1 is a top perspective view of a soap dispensing apparatus of the present disclosure according to one embodiment.

The embodiment and various embodiments can now be better understood by turning to the following detailed description of the embodiments, which are presented as illustrated examples of the embodiment defined in the claims. It is expressly understood that the embodiment as defined by the claims may be broader than the illustrated embodiments described below. Many alterations and modifications may be made by those having ordinary skill in the art without departing from the spirit and scope of the disclosure.

In one embodiment, the present disclosure is a soap dispensing apparatus 100 as shown in FIGS. 1, 5, 7, 8 and 12. The soap dispensing apparatus 100 comprises a housing 110 with a top face 102 and a base 104 directly opposite said top face 102, a scrubber element 120 removably couplable to the top face 102, a plurality of soap dispensing channels 130 disposed on the top face fluidly coupled to a soap platform 150. The soap platform 150 is adapted to be received by the housing 110. The soap dispensing apparatus 100 comprises a reservoir 140 adapted to receive a liquid soap; a spindle 152; a platform 154 adapted to move along a length of the spindle; a handle 160 adapted to rotate about an axis defined by the length of the spindle thereby pushing the platform up the length of the spindle and moving the liquid soap to the top face and wherein the soap dispensing apparatus is leak resistant.

In one embodiment as shown in FIG. 1, the soap dispensing apparatus 100 comprises a housing 110 with a top face 102 and a base 104 directly opposite the top face 102 and a groove 112 along a perimeter of the top face, a scrubber element (120) removably couplable to the top face and adapted to be positioned on the groove of the housing, a plurality of soap dispensing channels 130 disposed on the top face 102 fluidly coupled to a soap platform 150. The soap platform 150 is adapted to be received by the housing 110 and includes a reservoir 140 adapted to receive a liquid soap, a spindle 152, a platform 154 parallel the base and adapted to move perpendicularly along a length of the spindle. The soap platform 150 also includes a handle 160 adapted to rotate about an axis defined by the length of the spindle thereby pushing the platform up the length of the spindle and moving the liquid soap to the top face and wherein the soap dispensing apparatus is leak resistant.

While in some embodiments, the soap dispensing apparatus is disposable and for a single time use, in other embodiments, the apparatus is reusable either by refilling the reservoir with soap or by replacing the soap platform 150, and replacing the scrubbing element when necessary.

Figure 8:
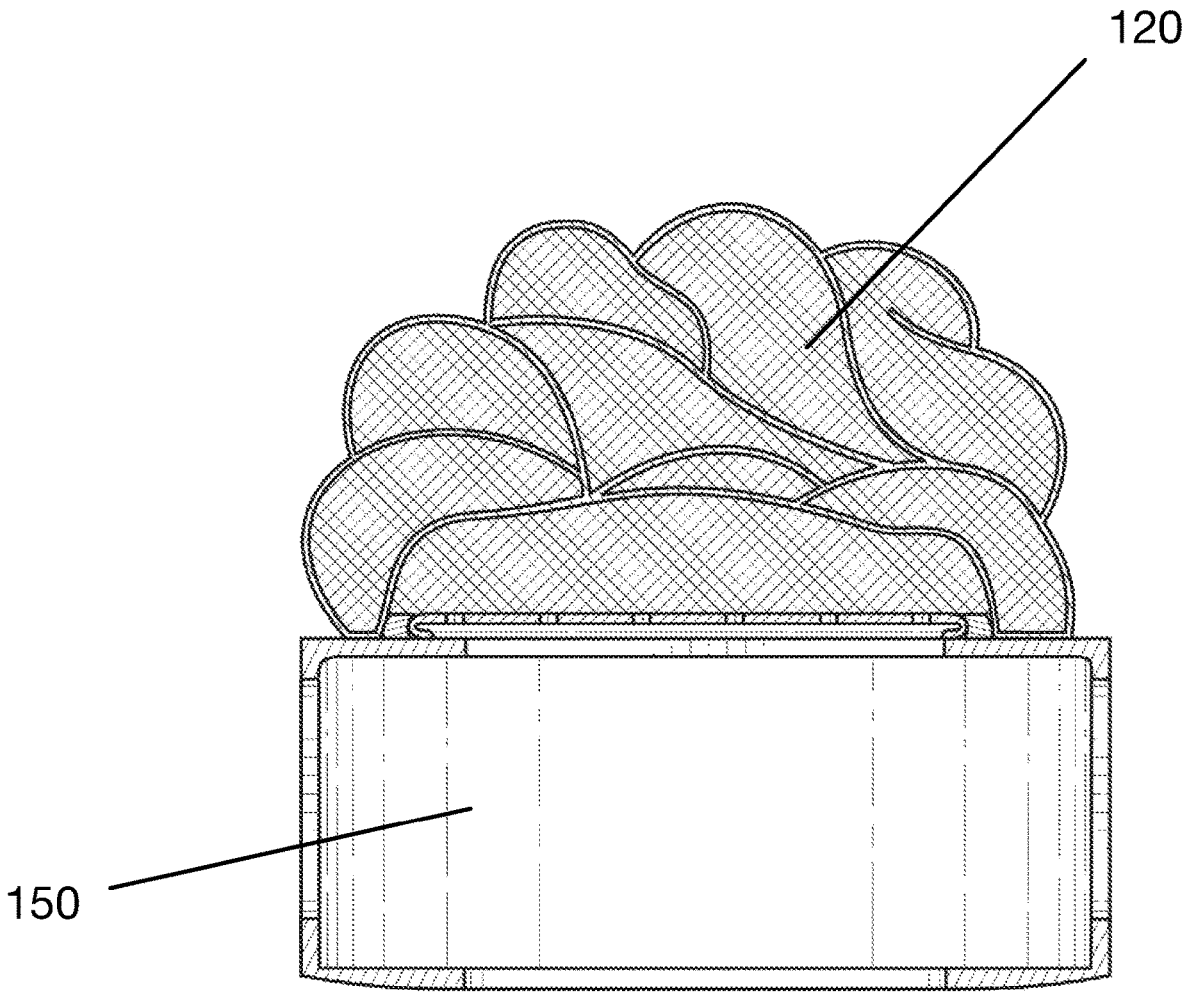
FIG. 8 is a side view of an alternative embodiment of the soap dispensing apparatus.

In one embodiment, the present disclosure is a soap dispensing apparatus 100 as shown in FIG. 8 including a housing 110 having a soap platform 150, a top face 102 and a base 104 directly opposite of the top face and distanced/separated by the reservoir 140. A scrubber element 120 is securely coupled to the top face. In some embodiments, the scrubber element is removably couplable to the housing 110 by coupling means such as elastic elements, Velcro®, hook and loop, reusable tape, mechanical snaps or any other waterproof and water-resistant coupling means.

In some embodiments the apparatus has a housing which is a curved structure constructed of a light-weight plastic material. The apparatus can also include a soap platform composed of a plastic material for carrying liquid soap that is coupled to the interior of the housing of said device with at least one bore hole for diffusion of the liquid soap.

As shown in FIGS. 1, 4, 5 7 and 11, a scrubber element 120 is securely coupled to the top face 102. In some embodiments, the scrubber element is removably couplable to the housing 110 by coupling means such as elastic elements, Velcro®, hook and loop, reusable tape, mechanical snaps or any other waterproof and water-resistant coupling means.

Figure 4:
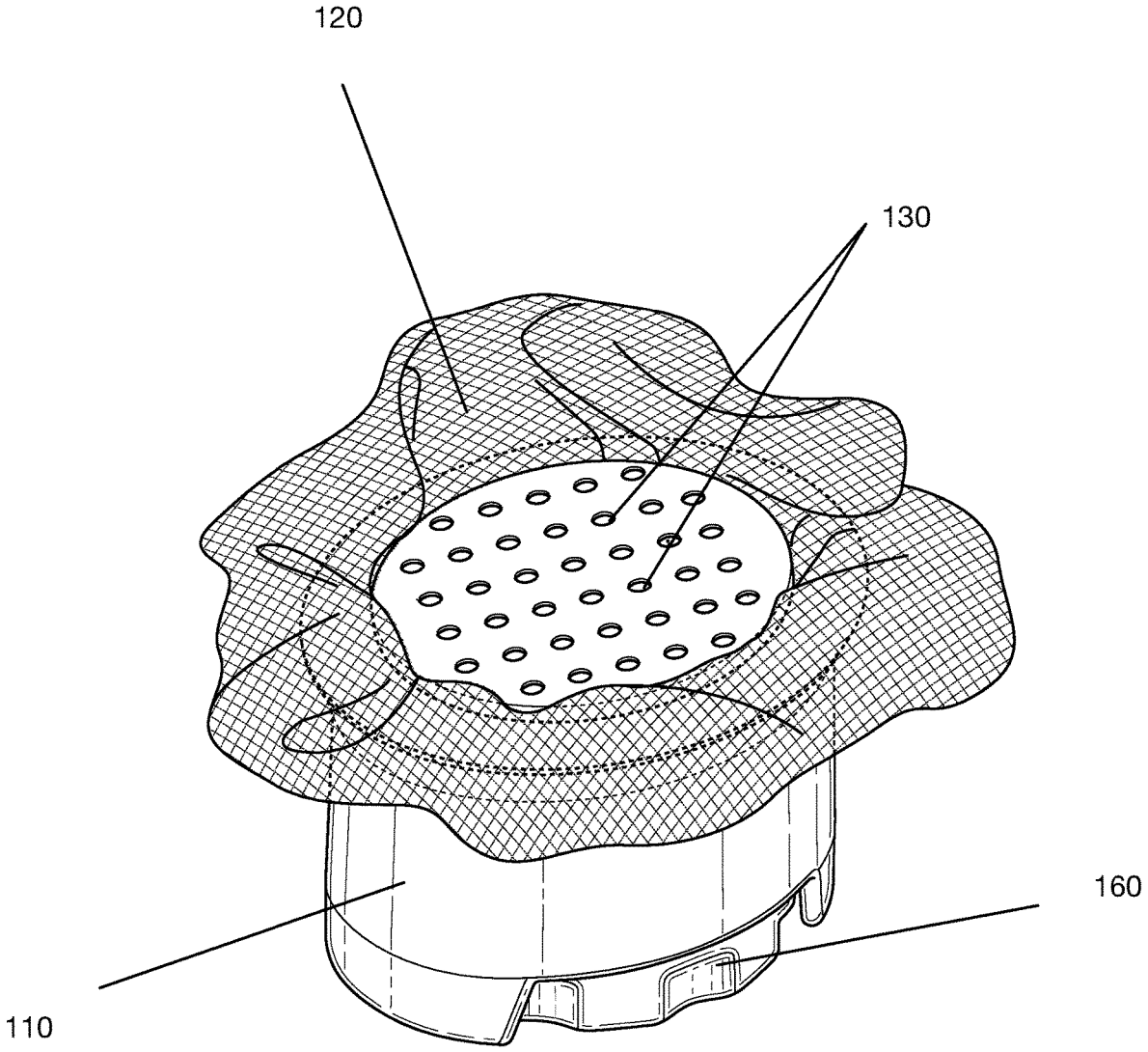
FIG. 4 is a top perspective view of an alternative embodiment of a soap dispensing apparatus of the present disclosure.
Figure 5:
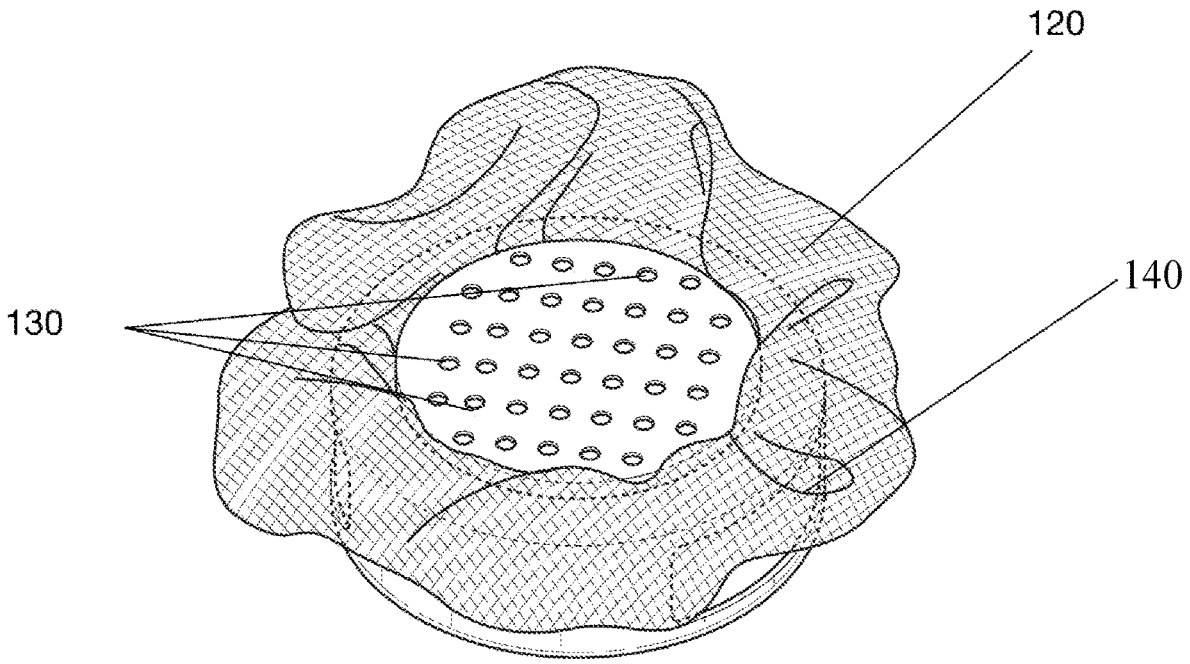
FIG. 5 is a top perspective view of another embodiment of a soap dispensing apparatus of the present disclosure.
Figure 6:
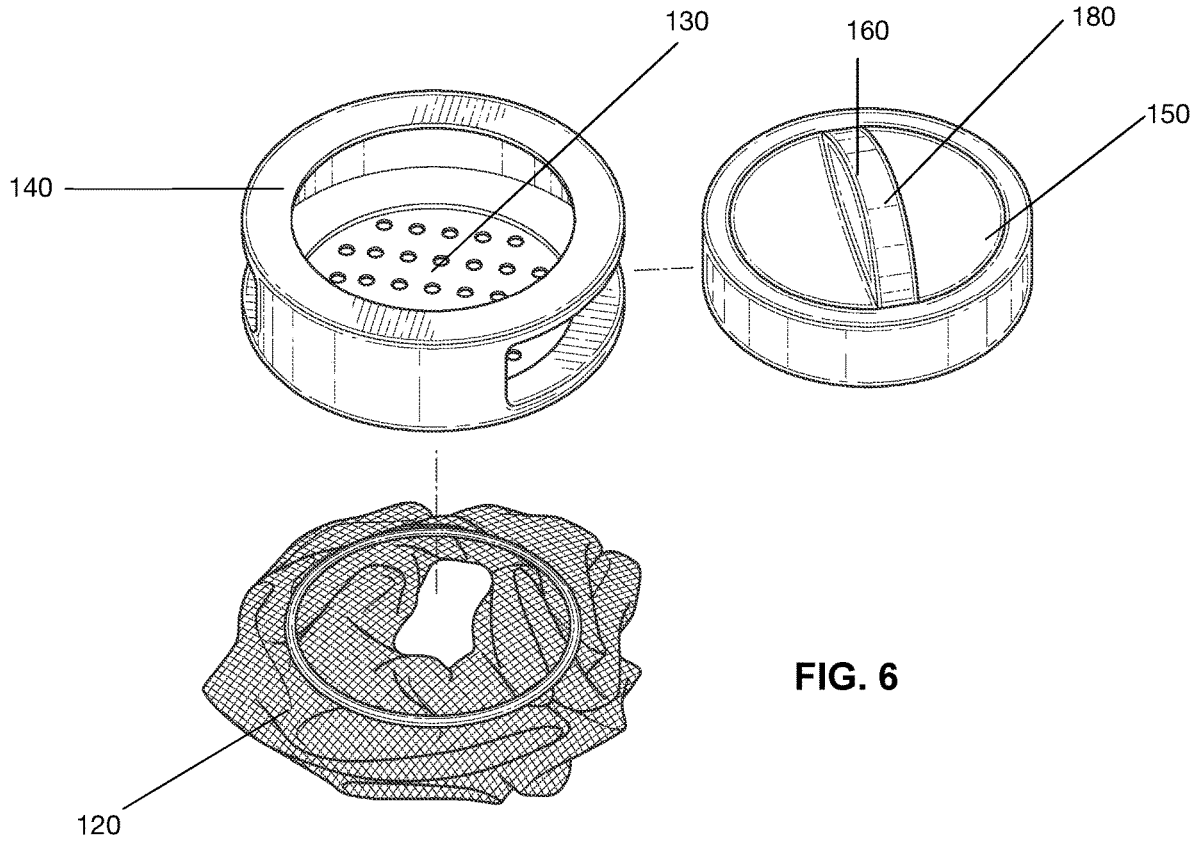
FIG. 6 is an exploded front view of one embodiment of a soap dispensing apparatus of the present disclosure.
Figure 7:
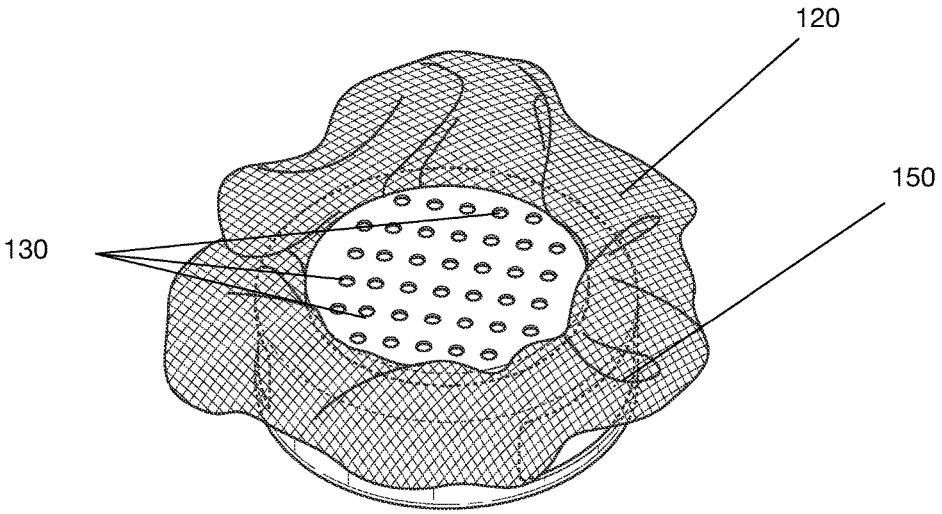
FIG. 7 is an assembled perspective view of another embodiment of the soap dispensing apparatus.

In some embodiments, as shown in FIGS. 4 and 7, the scrubber element surrounds an outer perimeter of the top face. In another embodiment the housing 110 comprises a ridge adjacent to the top face of the housing adapted to receive a removably couplable scrubber element. Here, the scrubber element can be elastically couplable to the soap dispensing apparatus. In some embodiments, the housing 110 has concave edges on the outside such that an elasticized scrubbing element 120 can fit around the concave edges.

In one particular embodiment as shown in FIGS. 4 and 7, the scrubbing element 120 is disposed on a perimeter of the top face to make sure that the dispensing channels 130 are not obstructed by the scrubbing element.

In an alternative embodiment, the scrubbing element can be a loofah, a sponge, a washcloth, a plurality of bristles, a plurality of filaments, and/or a plurality of protruding elements. In some embodiments, the scrubbing element 120 is fixed on the apparatus whereas in other embodiments, the scrubbing element 120 is removably couplable to the apparatus, and can be reusable and/or washable. In some embodiments, different types of materials can be used for the scrubbing element 120, such as a scrub, a sponge, natural fibers, brush and/or synthetic fibers or a combination thereof. In one particular embodiment, a silicone brush or gentle brush can be used as a scrubbing element 120 for use on pets. In some embodiments, the scrubbing element 120 only goes on the perimeter of the housing whereas in other embodiments, it covers the top face 102 of the apparatus 100.

Figure 11:
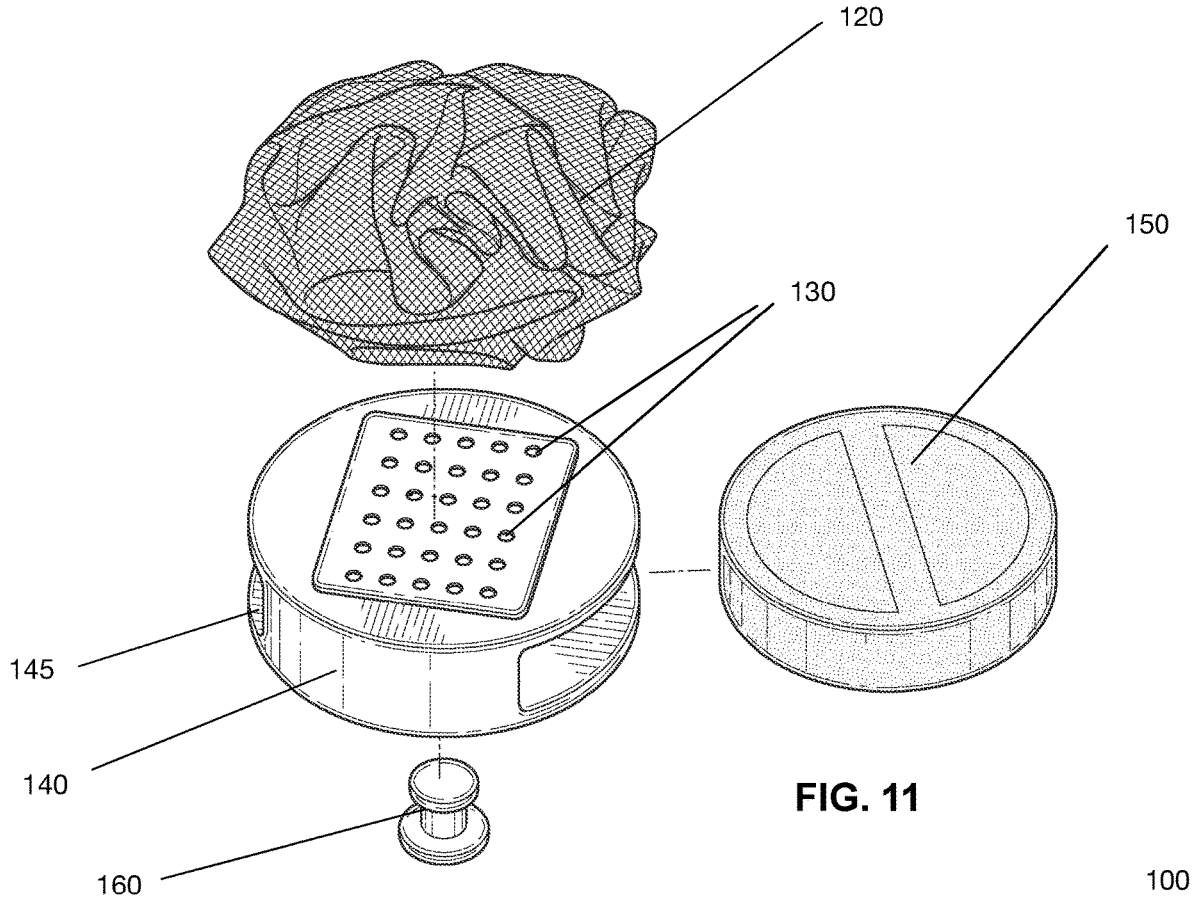
FIG. 11 is an exploded front view of another embodiment of a soap dispensing apparatus of the present disclosure.
Figure 12:
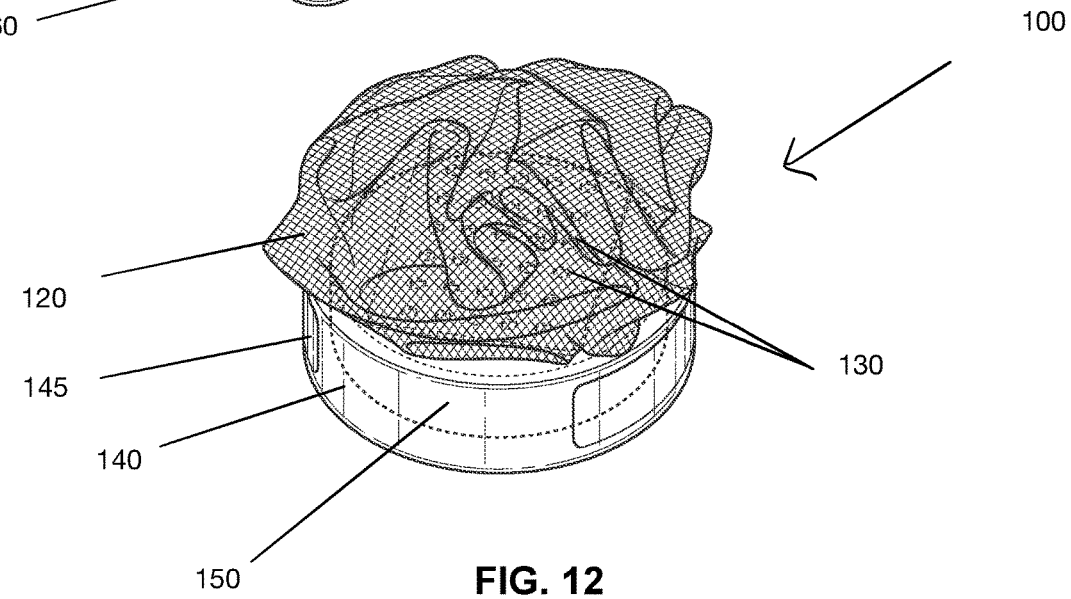
FIG. 12 is a perspective view of an alternative embodiment of a soap dispensing apparatus showing a removable platform and a removable scrubbing element.

As shown in FIGS. 4 11 and 12, the soap dispensing apparatus 100 also includes a plurality of soap dispensing channels 130 disposed on the top face and in fluid communication with the outside such that soap can easily flow out of the apparatus and onto a person's body or hands. A handle 160 is coupled to the base of the soap dispensing apparatus. In one particular embodiment, the soap dispensing apparatus 100 has a top face 102 which is in fluid communication with the scrubber element 120 via the plurality of soap dispensing channels 130.

In one particular embodiment, the soap dispensing channels 130 can include a variable diameter adapted to match a viscosity of the liquid soap. In another embodiment, the soap dispensing apparatus also includes a rotating lid including a plurality of openings such that when the lid is rotated, it adjusts a diameter of the soap dispensing channels adapted to match a viscosity of the liquid soap, and when the liquid soap with low viscosity utilizes a smallest diameter of the dispensing channels, and a high viscosity liquid soap utilizes a larger diameter of the dispensing channels.

In some embodiments, the dispensing channels 130 can further include regulating means and mechanisms structurally engageable with top face such that a user can twist the regulating means to adjust flow of soap to be dispensed.

In some embodiments, the dispensing channels 130 are coupled to the top face 102 of the apparatus, whereas in other embodiments, the dispensing channels 130 are coupled to the housing 110 such that the housing 110 and the top face 102 are hollow and open at the top face 102.

Figure 9:
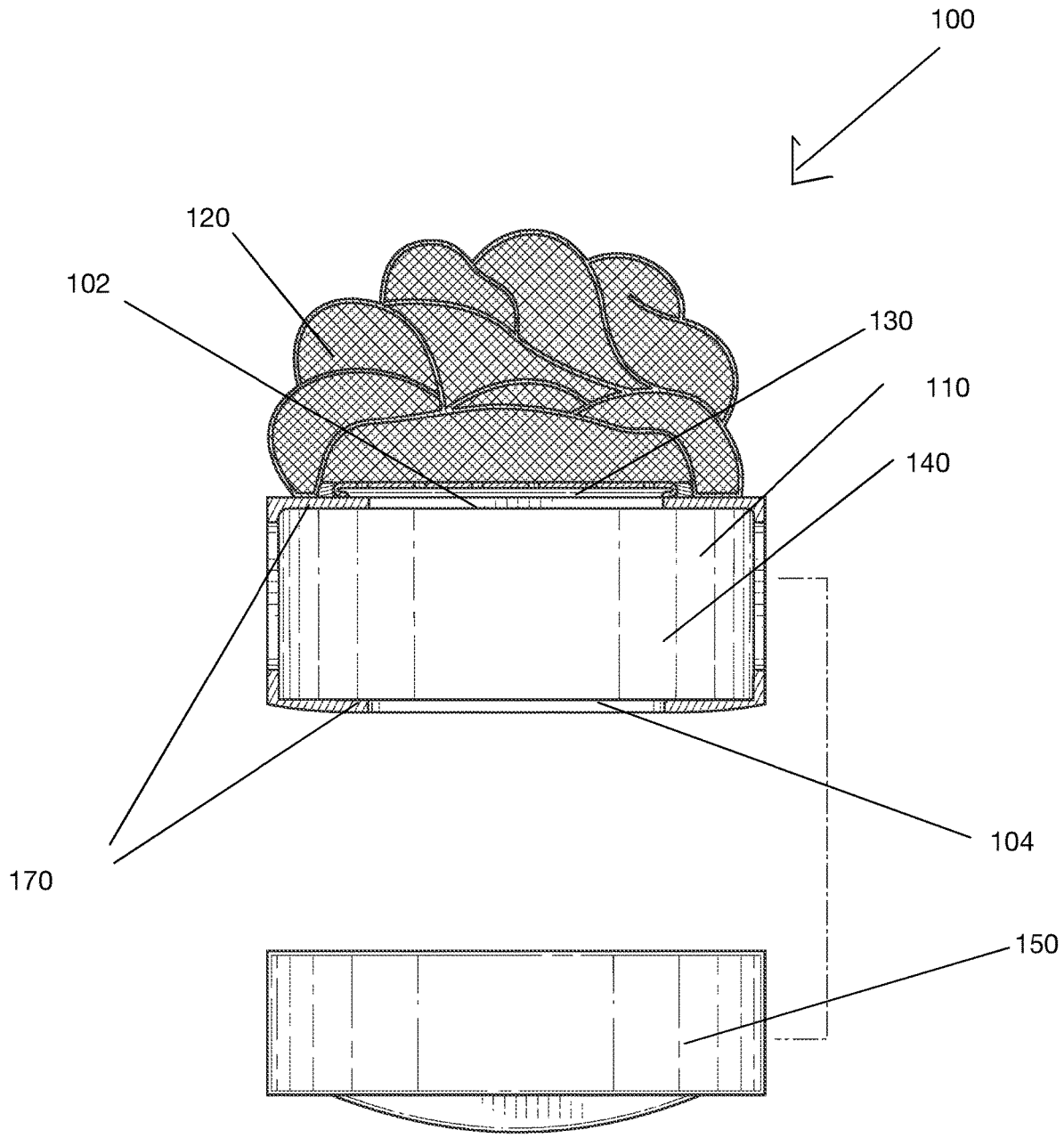
FIG. 9 is an exploded front view of another embodiment of a soap dispensing apparatus of the present disclosure.
Figure 10:
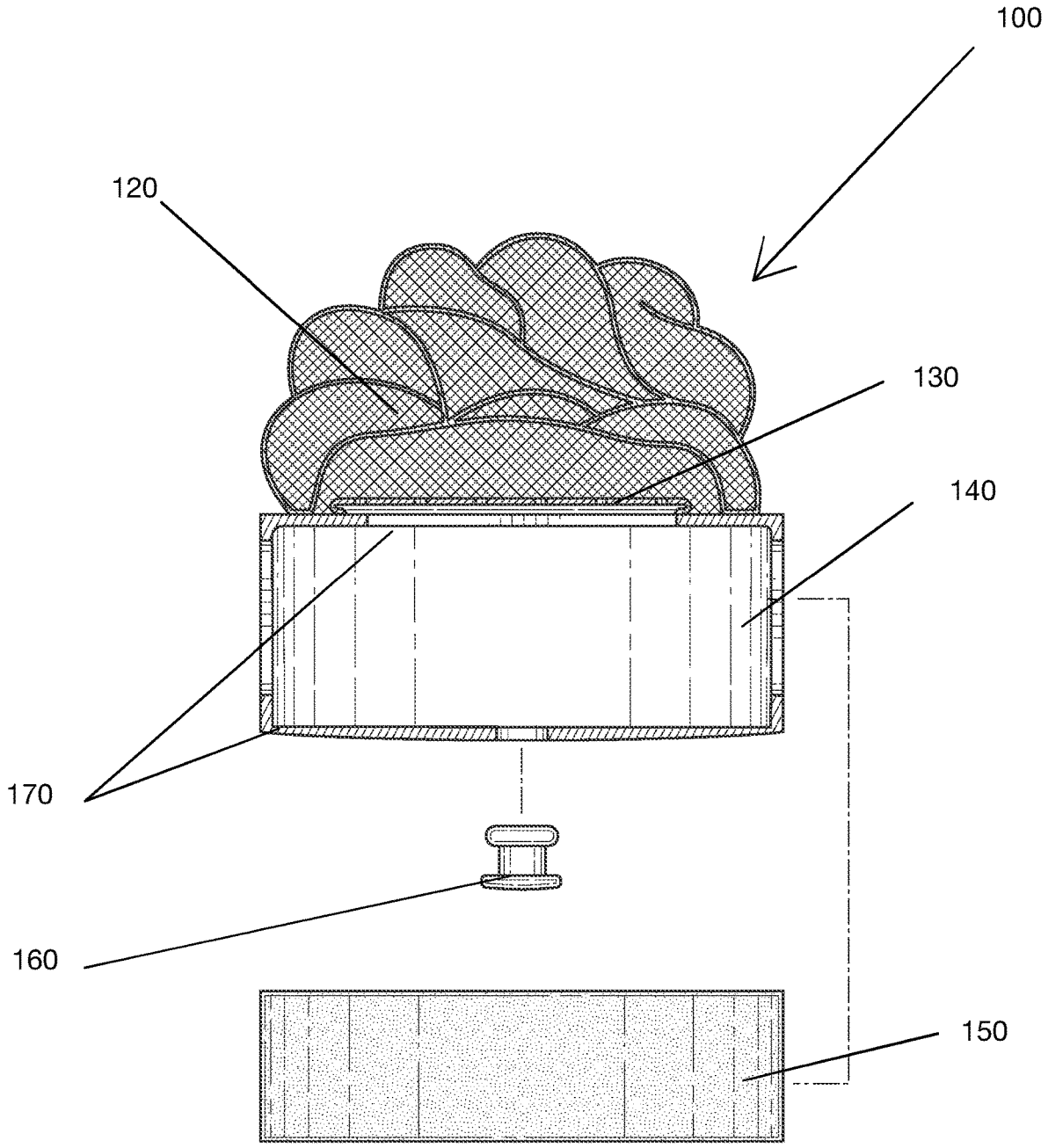
FIG. 10 is an exploded front view of yet another embodiment of a soap dispensing apparatus of the present disclosure.

While in some embodiments, the soap dispensing apparatus is adapted to receive a soap platform 150, in other embodiments, the soap dispensing apparatus includes a reservoir 140 which can be refillable such that a user can refill the reservoir with a soap as shown in FIG. 1. FIGS. 9, 11 and 12 in particular show an embodiment where a soap platform 150 is to be inserted within an opening in the housing 110. Here, the soap platform 150 can be slid within the housing 110 and the handle 160 is then used for soap dispensing.

In some embodiments as shown in FIG. 1 through 6, the soap dispensing apparatus has a reservoir 140 which is a hollow interior is adapted to receive a soap platform 150. Here, soap platform 150 is removably couplable to the apparatus. FIG. 7 show an alternative embodiment where the hollow interior or reservoir 140 is refillable whereas FIG. 8 shows an alternative embodiment where the hollow interior is adapted to receive a soap platform which is turn can be refillable by a user.

In one particular embodiment, the soap dispensing apparatus 100 has a regulating means structurally engageable with the top face where a user can rotate the regulating means to adjust a flow of a soap to be dispensed. The regulating means in one embodiment is an exact replica of the dispensing channels 130 on the top face 102, and when the regulating means and the dispensing channels are aligned on top of another, the flow is as its maximum. The flow is closed when the two are misaligned and the dispensing channels are closed.

In some embodiments, the soap dispensing apparatus 100 also comprises a seal 170 to make sure that no soap is leaked.

In some embodiments, the soap platform 150 and the reservoir 140 are refillable, while in other embodiments, it is a hollow interior as shown in FIGS. 11 and 12 adapted to receive a soap platform 150. Here, the soap platform 150 is removably couplable to the housing such that a user can remove and replace the soap platform 150.

In other embodiments, the soap platform 150 comprises a regulating means structurally engageable with the top face 102 where a user can rotate the regulating means to adjust a flow of the liquid soap to be dispensed. In other embodiments, the soap platform 150 is removably couplable to the housing 110 such that a user can remove and replace the soap platform 150. In other cases, the soap platform 150 is refillable such that a user can add the liquid soap to the reservoir. In other cases, the reservoir 140 includes a seal coupled to the platform thereby rendering the soap dispensing apparatus leak resistant.

In one particular embodiment, the soap platform 150 includes a twist up mechanism. The mechanism uses the spindle 152, a platform 154 which moves up and down the length of the spindle 152 and a handle 160 structurally connected thereto. When the handle is rotated left or right, the platforms moves up or down thereby pushing the platform accordingly. When the platform 154 is pushed up, the liquid soap on the soap platform 150 and the reservoir 140 is moved up and dispensed through the dispensing channels 130. In one embodiment, the platform has means to lock the spindle from rotation when in a fully retracted position and hits a stop at the top or bottom of the spindle.

In another embodiment, the reservoir 140 includes an inner wall wherein the inner wall, the platform and the spindle form a tight seal such that the soap dispensing apparatus is leak resistant. In another embodiment, the reservoir further comprises a seal 170 coupled to the platform thereby rendering the soap dispensing apparatus leak resistant.

In some embodiments, the handle 160 can be of a knob, a protrusion, an elongated arm, and/or a grip.

In some embodiments as shown in FIGS. 9 and 11, the soap dispensing apparatus includes a knob handle 160 adapted to push a soap through said plurality of soap dispensing channels. The knob is used in conjunction with a pushing mechanism such that with each turn of the knob, an adequate amount of soap is pushed to the surface of the top face through the plurality of dispensing channels. As the know is rotated throughout the life of use of the soap, a pushing element moves up the soap and reduces the volume occupied by the soap. The soap is all depleted and the soap platform or refillable reservoir is empty when the push element is adjected to the top face 102 of the soap dispensing apparatus 100.

In one embodiment, the soap platform 150 includes a knob handle 160 to push up a soap onto the surface of the apparatus. Here, the knob is the handle 160. In other embodiments, a push element or pump element is used to get the soap to come out of the soap platform or the reservoir 140. The cartridge may or may not be replaceable. In one particular embodiment, the soap platform 150 includes two or more chambers for different soaps, and user can choose which soap from which chamber. In another embodiment, the knob mechanism only pushes out a little bit of the product at the time.

The handle 160 can be removable or replaceable such that a user can choose what type of handle to use with the apparatus. The handle 160 can also be extendable or telescoping for the hard-to-reach areas such as the back. The handle 160 can also be fixed on the apparatus. In some embodiments, the knob handle 160 acts as a handle that a user can grip for use of the apparatus. In other embodiments, the handle 160 is an adjustable handle where user can put their hand through.

The present disclosure can also be embodied in a method of using a soap dispensing apparatus, including the steps of: a) inserting a soap platform carrying a soap into the apparatus; b) twisting a handle on the soap dispensing apparatus to dispense a liquid soap; and c) gripping the apparatus by a handle and using it to scrub a body of a person. Other embodiments and methods include the steps of removing the soap platform from said apparatus and replacing the soap platform once a soap is depleted, while others include the steps of refilling the soap dispensing apparatus with a liquid soap.

In yet another embodiment, the soap dispensing apparatus further includes a hanging element to allow a user to hang the apparatus. The handing element can be a hook and string to hang around surfaces, or a means to attach and/or stick the apparatus on a surface like a wall or glass.

The present disclosure is also embodied as a method for using a soap dispensing apparatus, including the steps of inserting a soap platform carrying soap into a body of the apparatus, gripping the apparatus and using to wash and/or scrub a body of a person, and removing the soap platform from the device and replacing it once soap is depleted.

The present disclosure can be embodied in a soap dispensing apparatus and personal cleaning device including a housing having a reservoir, a top face and a rear face directly opposite the top face and distanced by the reservoir. The soap dispensing apparatus includes a scrubber element such as a loofah material or other flexible material for cleaning, washing and/or exfoliating which is attached to part of the top face. The soap dispensing apparatus also includes a plurality of soap dispensing channels disposed on the top face which allow for soap to be dispended. The soap dispensing apparatus also includes a handle on the back of the apparatus such that a user can grip the apparatus by the handle for cleaning.

In one embodiment, the soap dispensing apparatus includes the scrubber element on the perimeter of the top face, and is attached to the apparatus by coupling means such as elastic elements. The user can remove and easily replace the scrubber element. The dispensing channels on the front of the apparatus are not obstructed by the scrubber element and the soap can easily flow onto a person's body. A replaceable soap platform is inserted within the apparatus' reservoir and can be replaced or refilled when depleted. The apparatus also includes a knob in the back which can be twisted by a user to only allow an adequate amount of soap to be dispensed and used. Here, the knob is adapted to push a soap through the plurality of soap dispensing channels.

In another embodiment the soap dispensing apparatus has a top face which is in fluid communication with the scrubber element via the plurality of soap dispensing channels. In another embodiment, the soap dispensing apparatus has a reservoir which is adapted to receive a soap platform and the soap platform is removably couplable to the apparatus.

In some embodiments, the soap dispensing apparatus has either a refillable reservoir, a reservoir adapted to receive a replaceable platform and/or adapted to receive either a replaceable platform or a platform adapted to be refillable.

In one embodiment, the soap dispensing apparatus includes a regulating means structurally engageable with the top face such that a user can rotate the regulating means to adjust the flow of soap to be dispensed. In some embodiments, the soap dispensing apparatus includes a seal to ensure that soap does not leak.

The present disclosure is also embodied in a method of using a soap dispensing apparatus, including the steps of inserting a platform containing a soap into the apparatus gripping the apparatus and using it to scrub a body of a person, and removing the platform from said apparatus and replacing the platform once a soap is depleted.

In one aspect, the present invention embodies a personal cleaning device comprised of an easy grip housing that fits into the palm of the hand and which houses a soap dispenser coupled with a flexible textile material for scrubbing and washing of the body.

In one embodiment, the disclosure is embodied by a light-weight rigid or flexible ovular, rectangular, or circular shaped structure serving as the body and which the front surface can be grasped easily within the palm of the hand. In yet another embodiment, the front surface of the body's structure can be smooth, grooved, textured, or covered with a removeable or non-removeable waterproof silicone, polyethylene, or polyethylene terephthalate non-slip gripping material. In another embodiment, the first and second sides of the housing's front surface have inwardly curved grooves for comfortably gripping and receiving the user's hand and fingers.

In an alternative embodiment, a flexible textile material is coupled to the rear surface of the body of the device by means of an adhesive glue, heating, snapping, sliding, clipping, twisting, or turning into place. The soft, porous, absorbent, massaging, or abrasive waterproof textile material, such as a luffa, sponge, mesh pouf, washcloth, brush bristles, or silicone pad, can be permanently or temporarily attached to the device's body. In yet another embodiment, the flexible textile material can be composed of natural polysaccharides such as cotton, dried luffa gourds, sea sponges, or textile fibers obtained from animals, or alternatively, of synthetic material such as silicone, polyethylene, or polyethylene terephthalate.

In another embodiment, the interior of the device's body houses a removable and replaceable polyethylene or silicone platform carrying soap which can be snapped, slid, clamped, screwed, twisted, or clasped into place. In yet another embodiment, the soap platform can be refilled by opening and/or closing a flexible and hollow internal valve by means of snapping, clipping, screwing, twisting or clasping.

In yet another embodiment, upon placement of the soap platform within the housing of the device through the front or rear surface, liquid soap is released onto the outside rear face of the device holding the attached flexible textile material by pushing a button, tilting downwards, squeezing on the flexible portion of the device, or by passive diffusion.

In another embodiment, the rear surface of the housing houses a porous grid structure composed of silicone, polyethylene, or polyethylene terephthalate for release of the liquid soap onto the flexible textile material.

As shown in FIG. 1, the soap dispensing apparatus 100 also includes a plurality of soap dispensing channels 130 disposed on the top face and in fluid communication with the outside such that soap can easily flow out of the apparatus and onto a person's body or hands. A handle 160 is coupled to the rear face of the soap dispensing apparatus. In one particular embodiment, the soap dispensing apparatus 100 has a top face 102 which is in fluid communication with the scrubber element 120 via the plurality of soap dispensing channels 130.

In some embodiments as shown in FIG. 5 through 12, the soap dispensing apparatus has a reservoir 140 which is a hollow interior is adapted to receive a soap platform 150. Here, soap platform 150 is removably couplable to the apparatus. FIG. 7 show an alternative embodiment where the hollow interior or reservoir 140 is refillable whereas FIG. 8 shows an alternative embodiment where the hollow interior is adapted to receive a soap platform 150 which is turn can be refillable by a user.

In some embodiments, the soap platform 150 has concave edges on the outside such that an elasticized scrubbing element 120 can fit around the concave edges.

In yet another embodiment, the soap dispensing apparatus further includes a hanging element to allow a user to hang the apparatus. The handing element can be a hook and string to hang around surfaces, or a means to attach and/or stick the apparatus on a surface like a wall or glass.

Figure 2:
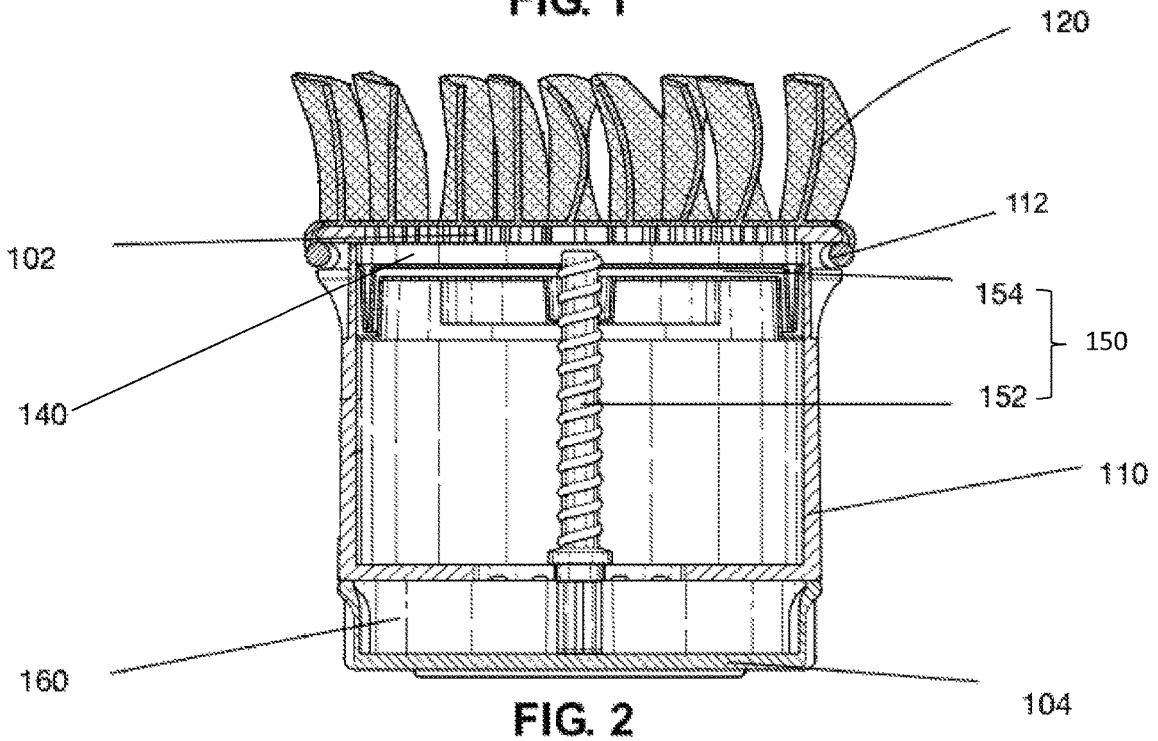
FIG. 2 is a cross sectional view of FIG. 1.

In some embodiments as shown in FIGS. 1 and 2, the soap dispensing apparatus includes a knob handle 160 adapted to push a soap through said plurality of soap dispensing channels. The knob is used in conjunction with a pushing mechanism such that with each turn of the knob, an adequate amount of soap is pushed to the surface of the top face through the plurality of dispensing channels. As the know is rotated throughout the life of use of the soap platform, a pushing element moves up the soap and reduces the volume occupied by the soap. The soap is all depleted and the soap platform or refillable reservoir is empty when the push element is adjected to the top face 102 of the soap dispensing apparatus 100.

While in some embodiments, the soap dispensing apparatus is adapted to receive a soap platform 150, in other embodiments, the reservoir 140 is refillable such that a user can refill the reservoir with a soap as shown in FIGS. 7 and 8.

Figure 3:
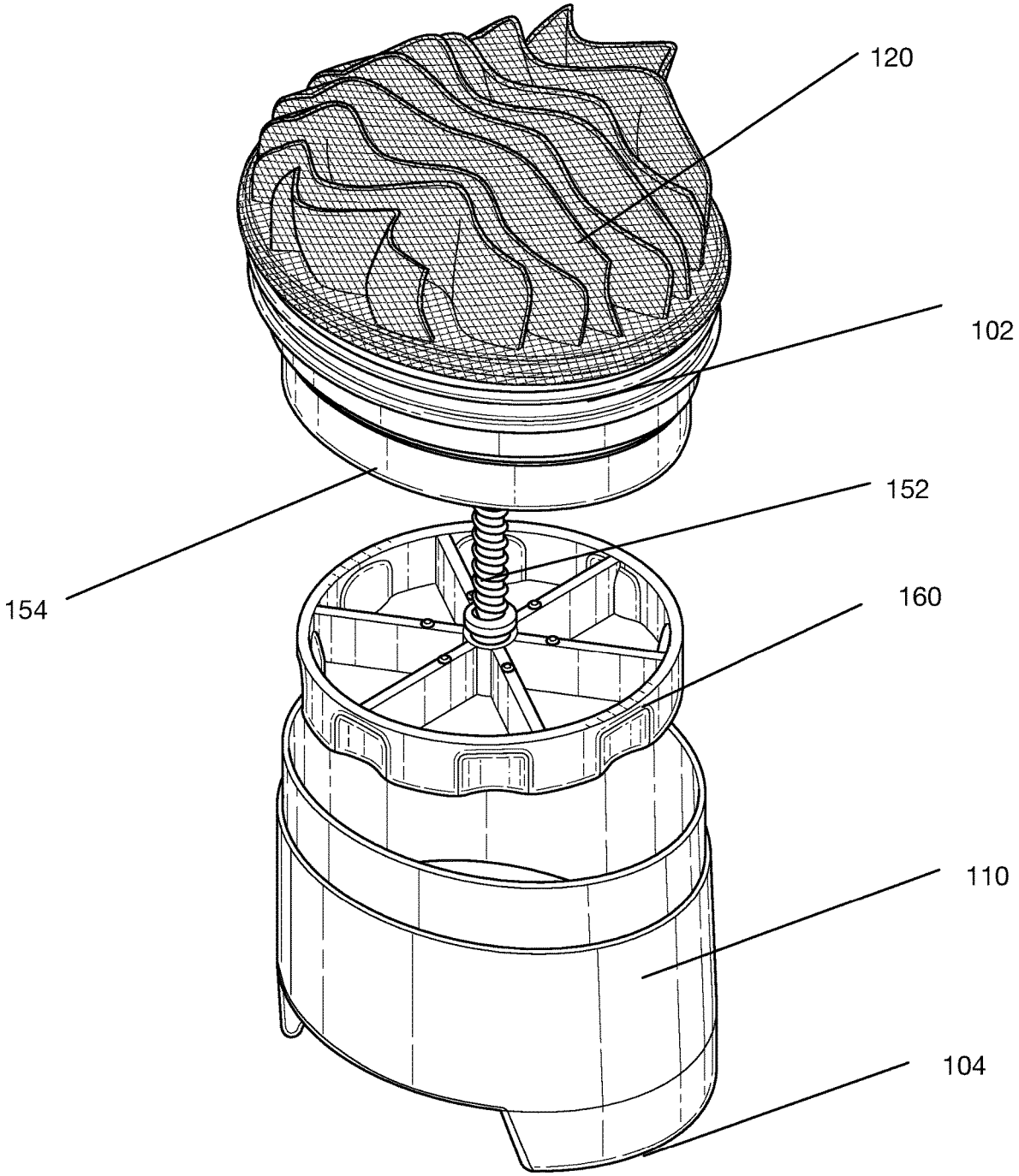
FIG. 3 is an exploded front view of one embodiment of a soap dispensing apparatus of the present disclosure.

In one particular embodiment as shown in FIGS. 3 and 8, the scrubbing element 120 is disposed on a perimeter of the top face to make sure that the dispensing channels 130 are not obstructed by the scrubbing element.

In one particular embodiment, the soap dispensing apparatus 100 has a regulating means structurally engageable with the top face where a user can rotate the regulating means to adjust a flow of a soap to be dispensed. The regulating means in one embodiment is an exact replica of the dispensing channels 130 on the top face 102, and when the regulating means and the dispensing channels are aligned on top of another, the flow is as its maximum. The flow is closed when the two are misaligned and the dispensing channels are closed.

In some embodiments, the soap dispensing apparatus 100 also comprises a seal 170 to make sure that no soap is leaked.

The present disclosure is also embodied as a method for using a soap dispensing apparatus, including the steps of inserting a soap platform containing a soap into a body of the apparatus, gripping the apparatus and using to wash and/or scrub a body of a person, and removing the soap platform from the device and replacing it once soap reservoir is depleted.

In one embodiment, the soap platform 150 includes a knob handle 160 to push up a soap onto the surface of the apparatus. Here, the knob handle 160 can act as a handle 160. In other embodiments, a push element or pump element is used to get the soap to come out of the soap platform 150 or the reservoir 140. The soap platform 150 may or may not be replaceable. In one particular embodiment, the soap platform 150 includes two or more chambers for different soaps, and user can choose which soap from which chamber.

In another embodiment, the knob mechanism only pushes out a little bit of the product at the time.

In some embodiments, the reservoir 140 is refillable, while in other embodiments, it is a hollow interior as shown in FIG. 2 adapted to receive a soap platform.

In some embodiments, the scrubbing element 120 is fixed on the apparatus whereas in other embodiments, the scrubbing element 120 is removably couplable to the apparatus, and can be reusable and/or washable. In some embodiments, different types of materials can be used for the scrubbing element 120, such as a scrub, a sponge, natural fibers, brush and/or synthetic fibers or a combination thereof. In one particular embodiment, a silicone brush or gentle brush can be used as a scrubbing element 120 for use on pets. In some embodiments, the scrubbing element 120 only goes on the perimeter of the housing whereas in other embodiments, it covers the top face 102 of the apparatus 100.

The handle 160 can be removable or replaceable such that a user can choose what type of handle to use with the apparatus. The handle 160 can also be extendable or telescoping for the hard to reach areas such as the back. The handle 160 can also be fixed on the apparatus. In some embodiments, the knob handle 160 acts as a handle that a user can grip for use of the apparatus. In other embodiments, the handle 160 is an adjustable handle where user can put their hand through.

In some embodiments, the dispensing channels 130 can further include regulating means and mechanisms structurally engageable with top face such that a user can twist the regulating means to adjust flow of soap to be dispensed.

In some embodiments, the dispensing channels 130 are coupled to the top face 102 of the housing 110, whereas in other embodiments, the dispensing channels 130 are coupled to the cartridge such that the housing 110 and the top face 102 are hollow and open at the top face.

In some embodiments the apparatus has a housing which is a curved structure constructed of a light-weight plastic material. The apparatus can also include a soap platform composed of a plastic material carrying liquid soap that is coupled to the interior of the housing of said device with at least one bore hole for diffusion of the liquid soap.

As mentioned above, other embodiments and configurations may be devised without departing from the spirit of the invention and the scope of the appended claims.

The invention claimed is:

1. A soap dispensing apparatus comprising:

a scrubber element;

a housing with a top face and a base directly opposite said top face, wherein the top face and the base are removably couplable, the scrubber element is removably couplable to the top face, the top face includes a plurality of soap dispensing channels distributed over the top face and adjacent to the scrubber element; and a soap platform adapted to be placed in the housing, wherein the housing and the soap platform form a reservoir adapted to receive a liquid soap and fluidly coupled to the plurality of the soap dispensing channels, the soap platform includes:

a spindle, wherein a distance between the top face and the spindle remains constant;

a platform having an opening configured for the spindle to pass through, the platform being adapted to move along a length of the spindle, wherein the spindle and the platform are configured to have corresponding threads; and a handle adapted to rotate about an axis defined by the length of the spindle thereby pushing the platform up the length of the spindle and moving the liquid soap to the top face and wherein the soap dispensing apparatus is leak resistant, wherein the base is decoupled from the top face in order to fill the liquid soap in the reservoir, the liquid soap leaves the housing through the plurality of the soap dispensing channels.

2. The soap dispensing apparatus of claim 1 wherein the reservoir further comprises an inner wall wherein the inner wall, the platform and the spindle form a tight seal such that the soap dispensing apparatus is leak resistant.

3. The soap dispensing apparatus of claim 1 wherein the scrubber element surrounds an outer perimeter of the top face.

4. The soap dispensing apparatus of claim 1 further comprising a ridge adjacent to the top face of the housing adapted to receive a removably couplable scrubber element and wherein said scrubber element is elastically couplable to the soap dispensing apparatus.

5. The soap dispensing apparatus of claim 1 wherein the reservoir formed by the housing and the soap platform is refillable.

6. The soap dispensing apparatus of claim 1 wherein the handle is at least one of a knob, a protrusion, an elongated arm, and a grip.

7. The soap dispensing apparatus of claim 1 wherein the scrubbing element is at least one of a loofah, a sponge, a washcloth, a plurality of bristles, a plurality of filaments, and a plurality of protruding elements.

8. The soap dispensing apparatus of claim 1 wherein the scrubber element surrounds an outer perimeter of the top face.

9. A soap dispensing apparatus comprising:

a housing with a top face and a base directly opposite said top face and a groove along a perimeter of the top face, wherein the top face and the base are removably couplable;

a scrubber element removably couplable to said top face and adapted to be positioned on the groove of the housing, wherein the top face includes a plurality of soap dispensing channels distributed over the top face and adjacent to the scrubber element;

a soap platform adapted to be placed in said housing, the housing and the soap platform form a reservoir adapted to receive a liquid soap and fluidly coupled to the plurality of the soap dispensing channels, the soap platform includes:

a spindle, wherein a distance between the top face and the spindle remains constant;

a platform having an opening configured for the spindle to pass through, the platform being parallel said based adapted to move perpendicularly along a length of the spindle, wherein the spindle and the platform are configured to have corresponding threads;

a handle adapted to rotate about an axis defined by the length of the spindle thereby pushing the platform up the length of the spindle and moving the liquid soap to the top face and wherein the soap dispensing apparatus is leak resistant; wherein the base is decoupled from the top face in order to fill the liquid soap in the reservoir, the liquid soap leaves the housing through the plurality of the soap dispensing channels.

10. The soap dispensing apparatus of claim 9 wherein the reservoir formed by the housing and the soap platform is refillable such that a user can add the liquid soap to the reservoir.

* * * * *